US006772752B1

(12) United States Patent
Boyer

(10) Patent No.: US 6,772,752 B1
(45) Date of Patent: Aug. 10, 2004

(54) COOLING SYSTEM AIRFLOW SENSOR FOR A COOKING APPLIANCE

(75) Inventor: Mark A. Boyer, Harrison, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/410,140

(22) Filed: Apr. 10, 2003

(51) Int. Cl.[7] ..... A21B 1/00

(52) U.S. Cl. ..... 126/21 A; 219/400; 219/681; 219/757

(58) Field of Search ..... 126/21 A, 21 R, 126/39 G, 273 R, 273 A; 219/400, 401, 681, 757, 490

(56) References Cited

U.S. PATENT DOCUMENTS

| | | | | |
|---|---|---|---|---|
| 4,331,124 A | | 5/1982 | Seidel et al. | |
| 4,373,504 A | | 2/1983 | Day | |
| 4,457,291 A | | 7/1984 | Henke | |
| 4,462,383 A | | 7/1984 | Henke et al. | |
| 4,513,233 A | | 4/1985 | Giammarrusco | |
| 4,756,473 A | | 7/1988 | Takemae et al. | |
| 4,797,600 A | * | 1/1989 | Savage et al. | 318/254 |
| 4,884,552 A | | 12/1989 | Wells et al. | |
| 4,964,392 A | | 10/1990 | Bruno et al. | |
| 5,363,024 A | | 11/1994 | Hiratsuka et al. | |
| 5,620,659 A | | 4/1997 | Revesz | |
| 6,051,824 A | * | 4/2000 | Choi et al. | 219/704 |
| 6,135,718 A | * | 10/2000 | Yang | 417/22 |
| 2002/0040902 A1 | | 4/2002 | Brown et al. | |

FOREIGN PATENT DOCUMENTS

DE 4222092 A1 * 1/1994

* cited by examiner

*Primary Examiner*—Jiping Lu
(74) *Attorney, Agent, or Firm*—Diederiks & Whitelaw, PLC

(57) ABSTRACT

A cooking appliance includes an oven cavity, one or more heat sources for generating hot oven gases within the oven cavity to perform a cooking operation, a controller and a cooling system. The cooling system includes a fan having a drive shaft upon which is mounted a multi-pole magnet. A Hall effect sensor is positioned adjacent to the magnet and provides pulses to the controller. Using the pulses, the controller calculates a speed of the cooling fan. If, during a cooking operation, the controller determines the fan is not operating, the cooking operation is halted. Likewise, if the controller determines the fan is operating at too low a speed, the cooking operation is halted. In either case, a corresponding fault code is generated and stored within the controller.

20 Claims, 4 Drawing Sheets

CALL SERVICE
CODE 5d21
UPPER OVEN
LOWER OVEN
CANCEL
More Options
Oven Light
Convect Bake
Broil
Clean
Help
Favorites
Setup
Enter
TIMER1 On/Off
TIMER2 On/Off
CPU
BAKE ELEMENT
BROIL ELEMENT
FAN
CONVECT HEATING ELEMENT
TEMP SENSORS
FAN SPEED SENSOR

COOLING SYSTEM AIRFLOW SENSOR FOR A COOKING APPLIANCE

BACKGROUND OF THE INVENTION

1. Field of the Invention

The present invention pertains to the art of cooking appliances and, more particularly, to a cooking appliance including a sensor for detecting the presence of a cooling airflow.

2. Discussion of the Prior Art

In general, providing a cooling airflow system in a cooking appliance is known. It is also known to provide a sensor or monitor to detect the presence of an airflow in the cooling system. The most common method used to detect the airflow includes providing a sail switch in an airflow path contained within the cooling system. A sail switch is actually a micro-switch having a large vane secured to a switch arm. With this arrangement, the cooling airflow impinges upon the vane, causing the switch arm to change position. This change of position provides a controller with information regarding the existence of the cooling airflow.

While this method enjoys wide use in the cooking appliance industry, sail switches are rather prone to failure. As a matter of fact, sail switches are somewhat delicate and, consequently, have multiple failure modes. For example, sail switches are subject to mechanical misalignment, shipping and other mechanical abuse and, finally, poor calibration. Each of the above examples would lead to a failure in the field. As modern appliances include a wide array of electronic components, undetected cooling system failure could result in costly damage to the appliance. Moreover, as safety standards set by regulatory and other agencies require that an oven be shut down in the event of cooling system failure, it is important to provide a monitor or sensor possessing a high degree of reliability.

Another method used to monitor for the cooling airflow includes providing a pressure sensor within the airflow path. This method primarily relates to commercial ovens where temperatures are high, the oven is operated for a prolonged period and a high pressure cooling airflow is provided to maintain cooler temperatures within control compartments of the oven. While appropriate for higher pressure airflows, such systems do not lend themselves to incorporation into residential ovens where airflows are provided at much lower pressure levels.

Therefore, despite the presence of these airflow monitoring systems in the prior art, still there exists a need for an improved airflow sensor arrangement for a cooking appliance airflow system. More specifically, there exists a need for an airflow sensor that maintains alignment and is capable of withstanding vibration and other abuses associated with shipping.

SUMMARY OF THE INVENTION

The present invention is directed to a cooling system airflow sensor provided in an oven. More specifically, the oven includes an oven cavity, a controller and a heat source for generating hot gases within the oven cavity. In addition, the oven includes a cooling system for preventing the oven gases maintained within the oven cavity from effecting the controller and, in addition, neighboring structure such as kitchen cabinetry and the like.

In accordance with a preferred form of the invention, the cooling system includes an air inlet and an air outlet separated by an air passage. Preferably, the air inlet is positioned along a control panel, with the air passage extending over the oven cavity. A cooling fan is arranged within the air passage for establishing a cooling airflow that is directed through the passage to various regions of the appliance and, ultimately expelled through the air outlet, preferably arranged in a rear portion of the appliance. More specifically, the cooling fan includes a drive shaft having secured thereto a multi-pole magnet. A Hall effect sensor is positioned in association with the multi-pole magnet for detecting a rotation of the drive shaft. The Hall effect sensor provides pulses to the controller that are translated into digital outputs used to calculate the speed of the fan.

In accordance with one aspect of the invention, if the controller determines that the cooling fan is being operated below a predetermined level, e.g. approximately 1000 RPM, the controller will assume that inadequate cooling is being provided to the appliance and terminate a current cooking operation. Once the cooking operation is terminated or cancelled, a corresponding fault code is generated by the controller for display to a user or service technician. In accordance with another aspect of the present invention, if the controller determines that the cooling fan is operating above a predetermined level, e.g., approximately 3000 RPM, the controller will assume that the fan has become detached from the drive shaft and the controller will again halt the current cooking operation, while generating and displaying a corresponding fault code.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
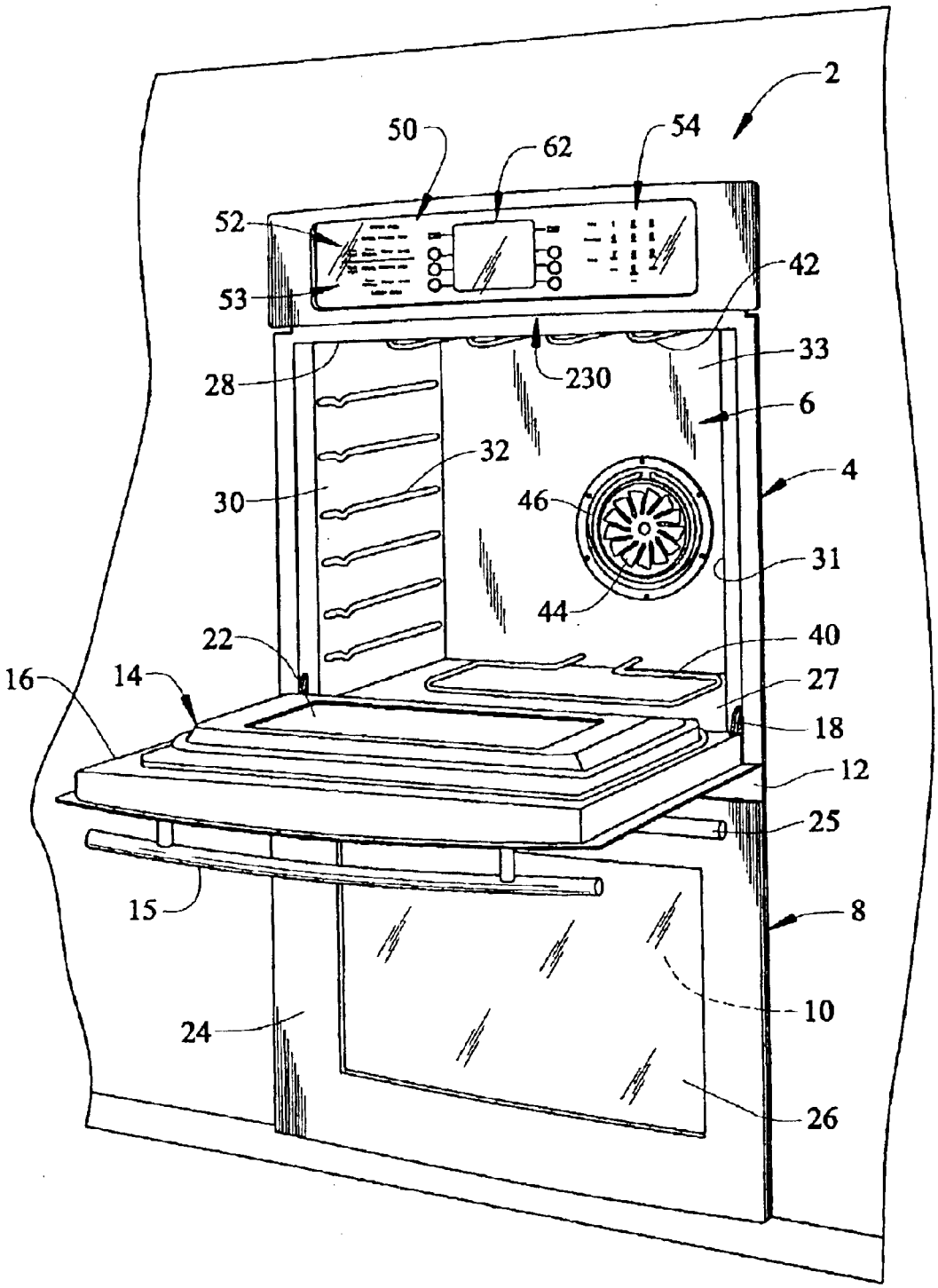
FIG. 1 is a perspective view of a wall oven constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention not limited to this model type and can be incorporated into various other types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting both upper and lower oven cavities 6 and 10.

In a manner known in the art, a door assembly 14 is provided to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24 including a handle 25 and a transparent zone or window 26 is provided to selectively access lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. In the preferred embodiment shown, bottom wall 27 is constituted by a flat, smooth surface designed to improve the cleanability of oven cavity 6. Arranged about bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. More specifically, both bake element 40 and top broiler element 42 are constituted by sheathed electric resistive heating elements.

Based on the above, in the preferred embodiment depicted, cooking appliance 2 actually constitutes an electric, dual wall oven. However, it is to be understood that cooking appliance 2 could equally operate on gas, either natural or propane. In any case, both oven cavities 6 and 10 preferably employ both radiant and convection heating techniques for cooking food items therein. To this end, rear wall 33 is shown to include a convection fan or blower 44. Although the exact position and construction of fan 44 can readily vary in accordance with the invention, in accordance with the most preferred form of the invention, fan 44 draws in air at a central intake zone (not separately labeled) and directs the air into oven cavity 6 in a radial outward direction. Also as clearly shown in this figure, another sheathed electric heating element 46, which preferably takes the general form of a ring, extends circumferentially about fan 44 in order to heat the radially expelled air flow. At this point, it should be noted that a fan cover, which has not been shown for the sake of clarity of the drawings, extends about fan 44 and heating element 46, preferably with the cover having an associated central inlet and a plurality of outer radial outlet openings.

Figure 2:
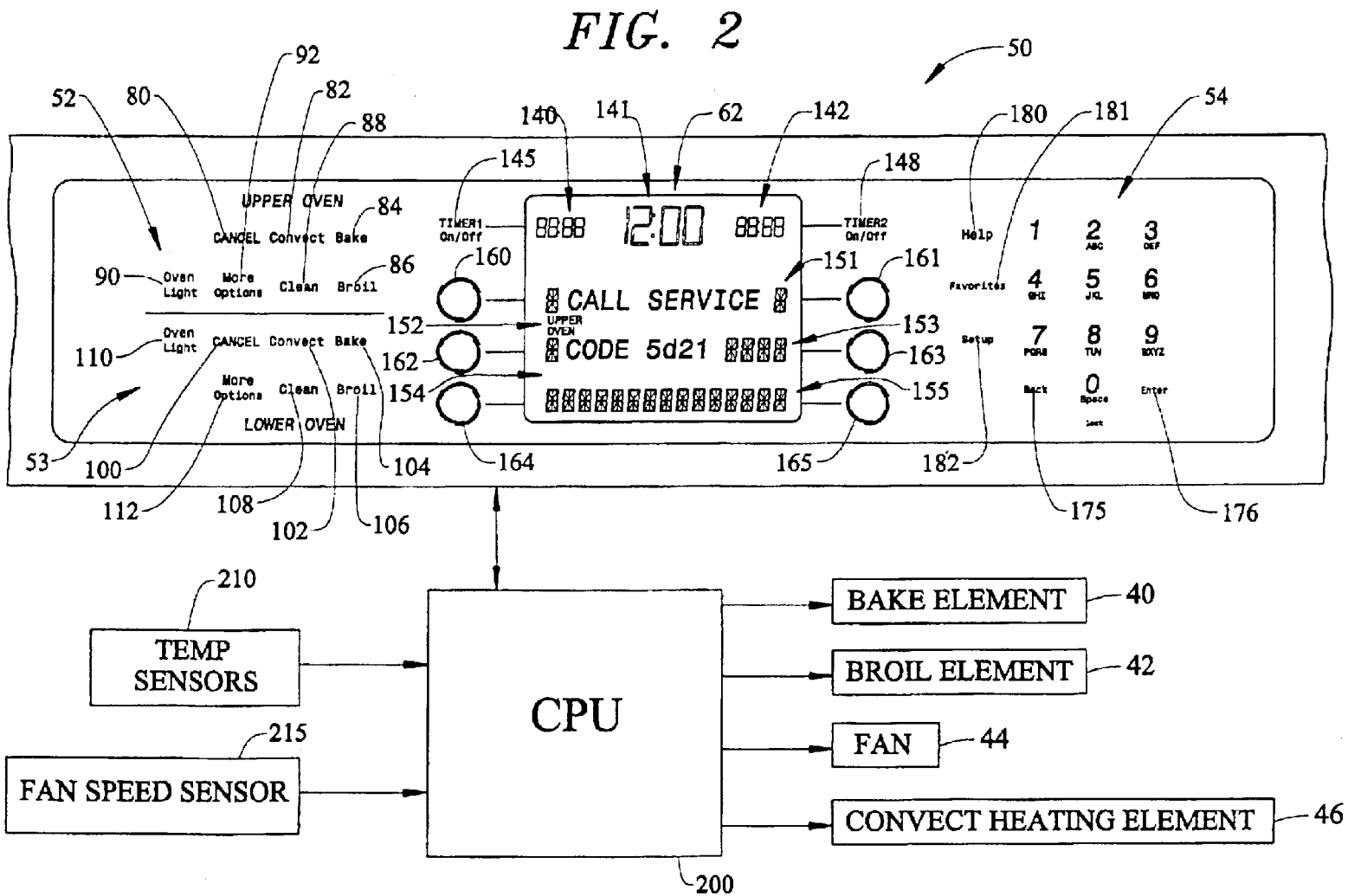
FIG. 2 is an enlarged view of a control panel employed in connection with the wall oven of FIG. 1.

As further shown in FIGS. 1 and 2, cooking appliance 2 includes an upper control panel 50 having a plurality of control elements. In accordance with one embodiment, the control elements are constituted by first and second sets of oven control buttons 52 and 53, as well as a numeric pad 54. Control panel 50 is adapted to be used to input desired cooking parameters to cooking appliance 2. More specifically, the first and second sets of control buttons 52 and 53, in combination with numeric pad 54 and a display 62, enable a user to establish particular cooking operations for upper and lower ovens 4 and 8 respectively.

In the preferred embodiment particularly shown in FIG. 2, first set of control buttons 52 includes a cancel button 80, a convection button 82, a bake button 84, a broil button 86, and a clean button 88. In addition, first set of control buttons 52 also preferably includes an oven light button 90 and a button 92 used to access more cooking options which are conveyed to the user through display 62. In a corresponding manner, second set of control buttons 52 includes a cancel button 100, a convection button 102, a bake button 104, a broil button 106, and a clean button 108. Furthermore, second set of control buttons 53 also preferably includes an oven light button 110 and a button 112 which is used to access more cooking options that are conveyed to the user through display 62.

To this end, display 62 is preferably divided into various sections. In accordance with the most preferred embodiment of the invention, an uppermost section of display 62 is sub-divided into three time display zones 140–142. More specifically, leftmost display zone 140 constitutes a first timer zone having an associated timer button 145. Central display zone 141 constitutes a clock for cooking appliance 2. Rightmost display zone 142 constitutes a second timer zone having an associated timer button 148.

Spaced below time display zones 140–142 are a series of vertically spaced information display zones 151–155. Each of information display zones 151, 153 and 155 has associated left and right portions (not separately labeled). As shown, each of the left and right portions have associated therewith laterally positioned selection buttons 160–165. As also shown, numeric pad 54 preferably enables alphanumeric input. That is, in addition to presenting numbers 0–9, numeric pad 54 doubles as an input source for alpha information. To this end, in a manner somewhat analogous to a telephone keypad, the number 2 button functions for ABC letter entry; the number 3 button functions for DEF letter entry; the number 4 button functions for GHI letter entry; the number 5 button functions for JKL letter entry; the number 6 button functions for MNO letter entry; the number 7 button functions for PQRS letter entry; the number 8 button functions for TUV letter entry; and the number 9 button functions for WXYZ letter entry. The number 0 button can also be used to input a space. On either side of the number 0 button are Back and Enter buttons 175 and 176 which can be used in combination with the various alpha keys for information entry. Finally, provided adjacent numeric pad 54 are Help, Favorites and Setup buttons 180–182.

In general, control panel 50 is linked to a controller or CPU 200 formed as part of cooking appliance 2. Therefore, CPU 200 receives user inputs and selections through control panel 50, as well as signals from sensors associated with cooking appliance 2, i.e. oven temperature sensors for upper and lower ovens 4 and 8 as generally indicated at 210 and a fan speed sensor 215. In turn, CPU 200 controls bake element 40, top broiler element 42, convection fan 44 and convection heating element 46.

Since various programming and general operation characteristics of cooking appliance 2 do not form part of the present invention, these features will not be discussed further here. Instead, the present invention is particularly directed to the operation of cooking appliance 2 based on the presence of a cooling airflow provided to maintain temperature levels of various regions of the cooking appliance within appropriate levels. More specifically, the invention is concerned with controlling the operation of cooking appliance 2 in the event the cooling air flow is absent or significantly reduced.

Figure 3:
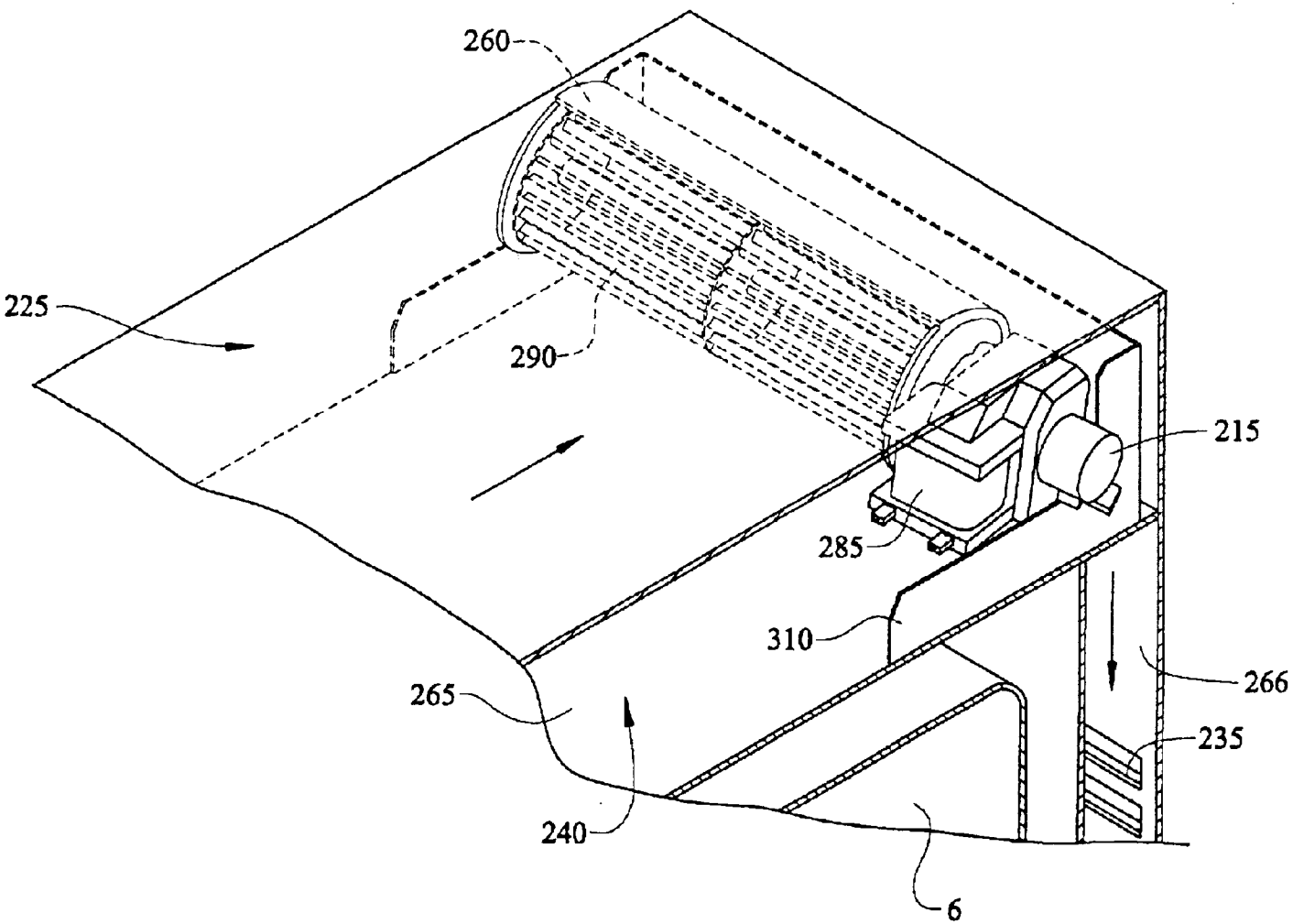
FIG. 3 is a partial cross-sectional view of the wall oven of FIG. 1, showing aspects of the cooling system of the invention.

With main reference to FIG. 3, cooking appliance 2 includes a cooling system indicated generally at 225. Cooling system 225 includes an air inlet portion 230 (FIG. 1) and an air outlet or exhaust portion 235 separated by an air passage 240. More specifically, a cooling fan 260 is arranged within air passage 240 to generate an air flow within cooking appliance 2. Actually, cooling fan 260 also serves to divide air passage 240 into an inlet section 265 and an exhaust section 266. In any event, with this arrangement, cooling fan 260 draws in an air flow through air inlet portion 230 over electronic control elements (not separately labeled) provided within control panel 50, directs the airflow over oven cavity 6, and thereafter directs the airflow through an outlet 270 (FIG. 4) to exhaust portion 235. Actually, as the airflow is directed over oven cavity 6, it is simultaneously directed below cabinet or wall structure arranged above cooking appliance 2. That is, cooling system 225 of the present invention not only provides a cooling air flow for electronic components (not separately labeled) carried by control panel 50, but prevents hot oven gases generated within oven cavity 6 from damaging neighboring structure.

Figure 4:
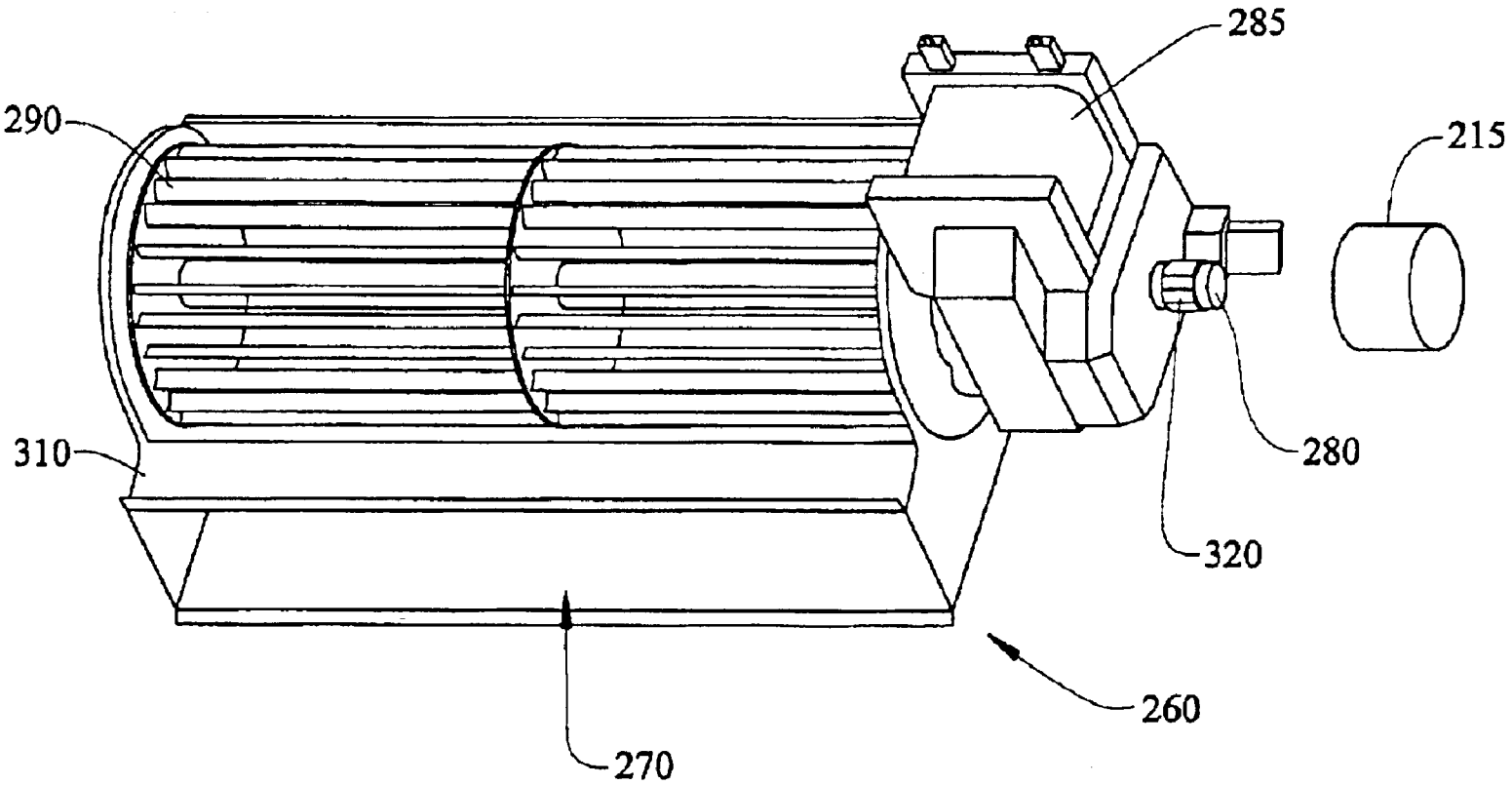
FIG. 4 is a partially exploded, perspective view of a fan assembly employed in the cooling system.

Referring to FIG. 4, cooling fan 260 includes a drive shaft 280 that interconnects a drive motor 285 with a fan blade 290. In the embodiment shown, fan blade 290 is constituted by a squirrel cage type fan. However, it should be understood that a wide variety of other fan blade assemblies are equally acceptable. In accordance with the most preferred form of the invention, a multi-pole magnet 320 is mounted for rotation with drive shaft 280 which, as will be detailed more fully below, interacts with sensor 215 to monitor the speed of cooling fan 260. Although multi-pole magnet 320 could be constituted by an 8-pole magnet, in the most preferred form, multi-pole magnet 320 is actually constituted by a 16-pole magnet. Regardless, cooling fan 260, drive shaft 280, drive motor 285, fan blade 290 and sensor 215 are mounted to a fan housing 310 and supported within air passage 240.

During operation of cooking appliance 2, sensor 215 monitors the speed of cooling fan 260. In further accordance with the most preferred form of the invention, sensor 215 is constituted by a Hall effect sensor which, in a manner known in the art, picks up pulses generated by multi-pole magnet 320 as drive shaft 280 rotates within sensor 215. Sensor 215 then translates the pulses to a digital output which is directed to CPU 200. With this arrangement, CPU 200 receives the digital output, calculates a speed of cooling fan 260 and, as will become apparent more fully below, controls the operation of cooking appliance 2 in dependence on the fan speed.

As indicated above, sensor 215 monitors the speed of cooling fan 260. As more and more electronics are employed in modem appliances, it has become imperative to ensure that the electronics are provided with an adequate cooling supply. In the event that a cooling air flow is discontinued for whatever reason to the electronics, hot oven gases generated within cooking appliance 2 could cause these components to overheat and fail. To address this concern, CPU 200 will terminate the operation of cooking appliance 2 in the event that the speed of cooling fan 260 falls below a predetermined level. In accordance with the most preferred form of the invention, controller 200 will terminate operation of cooking appliance 2 whenever the cooling fan speed falls outside a predetermined range, e.g. below approximately 1000 RPM. However, it is also important to note that a low fan speed is not the only indication of an inadequate air flow provided within cooling system 225. In the unlikely event that fan blade 290 disconnects from drive shaft 280, the operation of cooling system 215 will also be detrimentally affected. Therefore, CPU 200 also functions to terminate the operation of cooking appliance 2 in the event that sensor 215 detects a cooling fan speed in excess of a predetermined range, for example, above approximately 3000 RPM. As normal operation of cooling fan 260 falls within the range of 1800–2100 RPM in accordance with a preferred embodiment of the invention, therefore a speed in excess of approximately 3000 RPM would indicate that fan blade 290 has, for some reason, become detached from drive shaft 280 causing a disruption in the airflow.

In either case, i.e. sensor 215 detecting that cooling fan 260 is operating at a speed below a first predetermined level or above a second predetermined level, CPU 200, along with terminating the operation of appliance 2, will generate a fault code which will be presented on display 62. The specifics of the fault code do not form part of the present invention and are actually described in detail in commonly assigned U.S. Patent Application entitled "Diagnostic System For an Appliance" filed on even date herewith and incorporated herein by reference. In any event, it is seen that the cooling system of the present invention will provide the user with some measure of confidence that, in the event cooling fan 260 ceases functional operation, electronics of control panel 50 will be protected from overheating and ultimately leading to failure and costly repairs.

Although described with reference to a preferred embodiment of the present invention, it should be readily apparent of one of ordinary skill in the art that various changes and/or modifications can be made to the invention without departing from the spirit thereof. For instance, while the cooking appliance is described as including electrically operated heating components, the present invention is equally applicable to a gas operated cooking appliance. In addition, while the electronic components are described as being housed within the control panel, a variety of other locations are equally acceptable so long as the components are exposed to the cooling airflow. Finally, the air passage arranged above the oven cavity could extend to other regions of the cooking appliance as required by various design configurations. In general, the invention is only intended to be limited to the scope of the following claims.

I claim:

1. A cooking appliance comprising:

an oven cavity;

a heating system including at least one heat source positioned to develop a heated atmosphere within the oven cavity;

a control panel arranged adjacent to the oven cavity, said control panel including a plurality of control elements for inputting control parameters for a cooking operation; and a cooling system provided to establish a cooling airflow being directed, at least in part, along the control panel, said cooling system including:

a cooling fan having a drive shaft operatively connected to a fan blade;

a multi-pole magnet mounted for rotation with the drive shaft;

a Hall effect sensor positioned proximate to the multi-pole magnet, said Hall effect sensor generating a plurality of pulses as the drive shaft rotates; and a controller linked to both the control panel so as to receive the control parameters to establish the cooking operation, and the Hall effect sensor so as to receive the plurality of pulses, wherein the controller calculates a cooling fan speed based on the plurality of pulses generated by the Hall effect sensor, with said cooling fan speed being indicative of a presence of a cooling airflow in the cooling system, said controller terminating the cooking operation when the calculated cooling fan speed is outside a predetermined range.

2. The cooking appliance according to claim 1, wherein the controller terminates the cooking operation if the cooling fan speed falls below approximately 1000 RPM.

3. The cooking appliance according to claim 2, wherein the controller terminates the cooking operation if the cooling fan speed is greater than approximately 3000 RPM.

4. The cooking appliance according to claim 1, wherein the controller generates a fault code indicating that the cooking operation was terminated due to the cooling fan speed being outside the predetermined range.

5. The cooking appliance according to claim 1, wherein the multi-pole magnet is constituted by an 8 pole magnet.

6. The cooking appliance according to claim 1, wherein the multi-pole magnet is constituted by a 16 pole magnet.

7. The cooking appliance according to claim 1, further comprising:

an cooling air inlet positioned adjacent to the control panel, said cooling air inlet leading to the cooling fan.

8. The cooking appliance according to claim 7, further comprising:

an air flow passage leading from the cooling air inlet and over the oven cavity, wherein the cooling fan is provided within the air flow passage.

9. The cooking appliance according to claim 1, wherein the cooking appliance constitutes a dual oven wall unit.

10. The cooking appliance according to claim 1, wherein the fan blade constitutes a squirrel cage.

11. A method of monitoring an airflow generated for cooling, at least in part, a controller for a cooking appliance comprising:

initiating a cooking operation in an oven cavity of the cooking appliance;

operating a cooling fan, including a drive shaft having arranged thereon a multi-pole magnet, to establish a cooling airflow;

rotating the multi-pole magnetic with the drive shaft in proximity to a Hall effect sensor, with said Hall effect sensor generating a plurality of pulses;

directing the plurality of pulses to the controller;

calculating a speed of the cooling fan based on the plurality of pulses, with said cooling fan speed being indicative of a presence of the airflow; and terminating the cooking operation if the cooling fan speed is outside a predetermined range.

12. The method of claim 11, further comprising:

positioning the cooling fan in an air passage; and drawing the airflow to the cooling fan through a control panel inlet opening.

13. The method of claim 12, further comprising:

directing the airflow over the oven cavity prior to the airflow reaching the cooling fan.

14. The method of claim 11, wherein the cooking operation is terminated if the cooling fan speed is below a predetermined level.

15. The method of claim 14, wherein the cooking operation is terminated if the cooling fan speed is below approximately 1000 RPM.

16. The method of claim 14, further comprising:

generating a fault code indicating that the cooling fan speed has fallen below the predetermined level.

17. The method of claim 11, wherein the cooking operation is terminated if the cooling fan speed exceeds a predetermined level.

18. The method of claim 17, wherein the cooking operation is terminated if the cooking fan speed is greater than approximately 3000 RPM.

19. The method of claim 17, further comprising:

generating a fault code indicating that the cooling fan speed has exceeded the predetermined level.

20. The method of claim 11, further comprising:

displaying a fault code on a display provided on the cooking appliance when the cooling fan speed is outside the predetermined range.

* * * * *